US005447391A

United States Patent [19]

Gallaher et al.

[11] Patent Number: 5,447,391

[45] Date of Patent: Sep. 5, 1995

[54] OFFSHORE PLATFORM STRUCTURE AND SYSTEM

[75] Inventors: Dale M. Gallaher, Metairie; George E. Sgouros, New Orleans, both of La.

[73] Assignee: Shell Oil Company, Houston, Tex.

[21] Appl. No.: 129,820

[22] Filed: Sep. 30, 1993

[51] Int. Cl.[6] ..... E02B 17/00

[52] U.S. Cl. ..... 405/203; 405/195.1; 405/196

[58] Field of Search ..... 405/195.1, 196, 203, 405/204, 222, 223, 224, 224.2, 225–228

[56] References Cited

U.S. PATENT DOCUMENTS

| | | | |
|---|---|---|---|
| 3,380,520 | 4/1968 | Pease . | |
| 3,428,338 | 2/1969 | Corwin . | |
| 3,535,884 | 10/1970 | Chaney . | |
| 3,550,384 | 12/1970 | Bardgette et al. . | |
| 3,575,005 | 4/1971 | Sumner . | |
| 3,716,994 | 2/1973 | Pogonowski . | |
| 3,860,270 | 1/1975 | Arnold . | |
| 3,885,298 | 5/1975 | Pogonowski . | |
| 4,083,193 | 4/1978 | Evans . | |
| 4,126,011 | 11/1978 | Lamy et al. | 405/196 |
| 4,147,385 | 4/1979 | van der Velden . | |
| 4,184,790 | 1/1980 | Bassett . | |
| 4,222,683 | 9/1980 | Schaloske et al. | 405/204 |
| 4,412,759 | 11/1983 | Britton et al. . | |
| 4,413,926 | 11/1983 | Ninet | 405/204 |
| 4,422,805 | 12/1983 | Sweatman . | |
| 4,436,454 | 3/1984 | Ninet et al. | 405/204 |
| 4,456,404 | 6/1984 | Evans | 405/196 |
| 4,492,270 | 1/1985 | Horton | 405/204 X |
| 4,501,514 | 2/1985 | Lowes . | |
| 4,583,881 | 4/1986 | Steele | 405/203 X |
| 4,585,374 | 4/1986 | Regalbuto et al. . | |
| 4,607,982 | 8/1986 | Brasted et al. | 405/204 |
| 4,633,953 | 1/1987 | LeBoeuf et al. | 405/204 X |
| 4,698,896 | 10/1987 | Osterwald et al. . | |
| 4,723,875 | 2/1988 | Sutton | 405/204 |
| 4,740,107 | 4/1988 | Casbarian et al. | 405/204 X |
| 4,761,097 | 8/1988 | Turner | 405/204 |
| 4,762,442 | 8/1988 | Thomas et al. | 405/196 |

(List continued on next page.)

FOREIGN PATENT DOCUMENTS 201412 12/1982 Japan ..... 405/195.1

OTHER PUBLICATIONS

"Latest Technology Stresses Smarter, Quicker Operation" (Kurt S. Abraham, International Editor and Henry D. Terrell, News Editor), *World Oil,* Jul. 1990, pp. 39–53.

"The Hydra-Lok Pile Swaging Tool," Marine Contractor Services, Inc. (MCS) (Copyright 1992), 18501 Aldine Westfield Rd., Houston, Tex. 77073.

"Unique Drilling, Production Jackup Set for 1993 Delivery," *Offshore,* vol. 51, No. 2, Feb. 1991, p. 42.

"Offshore Technology Conference '91," *World Oil,* Apr. 1991, pp. 121–135.

(List continued on next page.)

*Primary Examiner*—Randolph A. Reese
*Assistant Examiner*—John A. Ricci
*Attorney, Agent, or Firm*—Mark A. Smith

[57] ABSTRACT

An offshore platform structure is disclosed for facilitating use of a jack-up rig for well operations in deepwater applications while reducing the jacket size and increasing the flexibility of field development. The structure has a bottom founded jacket base and a surface tower supported by the jacket base and extending above the ocean surface. A platform deck is supported by the surface tower and a subsea rig support interface is presented at the top of the jacket base which is adapted to receive the jack-up rig for well operations. Another aspect of the present invention is an offshore platform system which includes a jack-up rig having a plurality of legs extending from a combination hull/deck structure and engaging the rig support interface. Well operations equipment provided by the jack-up rig which includes a cantilever deck extending from the combination hull and deck structure to present a derrick in substantial vertical alignment with the surface tower.

30 Claims, 5 Drawing Sheets

U.S. PATENT DOCUMENTS

| | | | |
|---|---|---|---|
| 4,768,275 | 9/1988 | Schmitz . | |
| 4,805,945 | 2/1989 | Foucault et al. . | |
| 4,848,967 | 7/1989 | Weyler | 405/204 |
| 4,854,778 | 8/1989 | Valenzuela | 405/204 |
| 4,875,270 | 10/1989 | Krips et al. . | |
| 4,902,169 | 2/1990 | Sutton | 405/204 |
| 4,902,170 | 2/1990 | Knox et al. . | |
| 4,917,541 | 4/1990 | Carruba | 405/227 |
| 4,934,869 | 6/1990 | Brandon et al. | 405/199 |
| 5,028,171 | 7/1991 | Gray . | |
| 5,049,004 | 9/1991 | Niimura | 405/204 |
| 5,094,568 | 3/1992 | Carruba | 405/227 |
| 5,102,266 | 4/1992 | Carruba | 405/227 |
| 5,163,783 | 11/1992 | Fahrmeier et al. | 405/195.1 |
| 5,228,806 | 7/1993 | DeMedieros et al. . | |
| 5,288,174 | 2/1994 | Kjersem et al. . | |

OTHER PUBLICATIONS

"Jack-Up Monopile Platform Uses Gravity-Base Storage," *Ocean Industry,* Apr./May 1991, p. 106.

George I. Viegas, "New Jackup Designs Proposed for Deepwater Operations," *Offshore,* vol. 51, No. 6, Jun. 1991, pp. 52–53.

"New Technology Is Shaped by North Sea, Subsea Markets" (Kurt S. Abraham, International Editor, Mark E. Teel, Engineering Editor, T. R. Wright, Jr., Editor), *World Oil,* Jul. 1991, pp. 39–56.

"Multi-Purpose Jack-Up Stands on Single Leg," *Ocean Industry,* Aug. 1991, pp. 39–40.

"European Operators, Drillers Embark on Cost-cutting Programs" (Neil Potter, News Editor, London), *Offshore,* Aug. 1991, pp. 33–40.

"Jack-Up Platform Suits Marginal Field Needs," *Ocean Industry,* Apr./May 1992, pp. 118–120.

Jeremy Beckman, "North Sea," *Offshore/Oilman,* vol. 52, No. 10, Oct. 1992, p. 12.

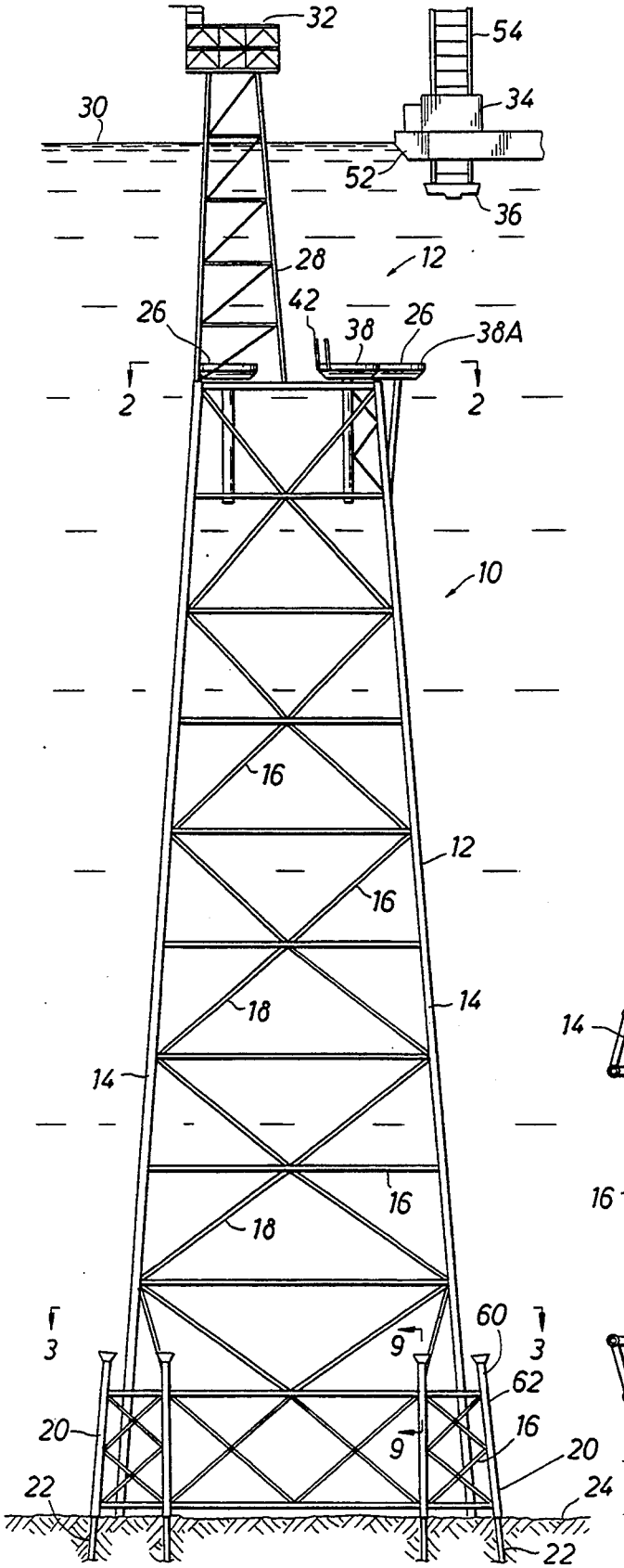
FIG. 1
FIG. 2
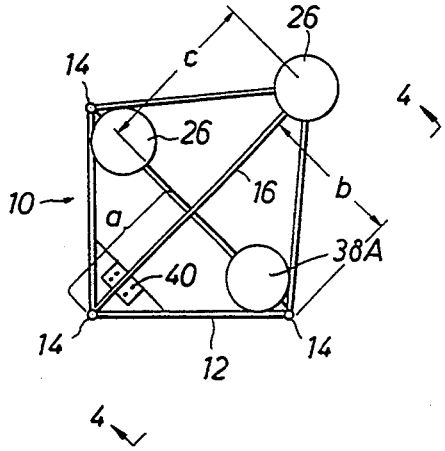
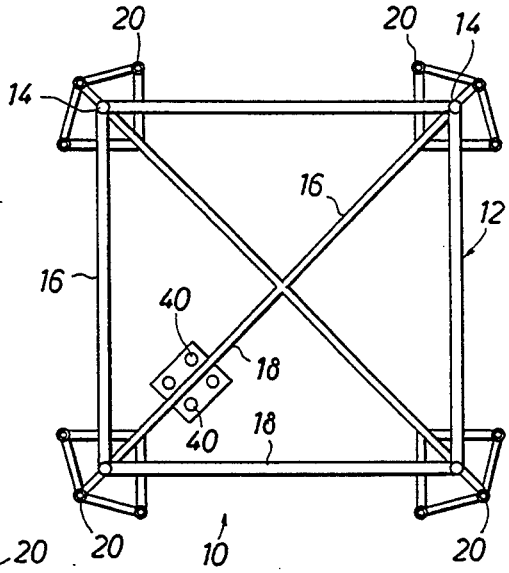
FIG. 3

FIG.5
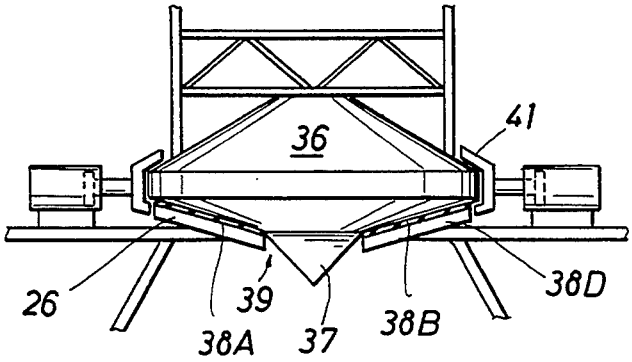
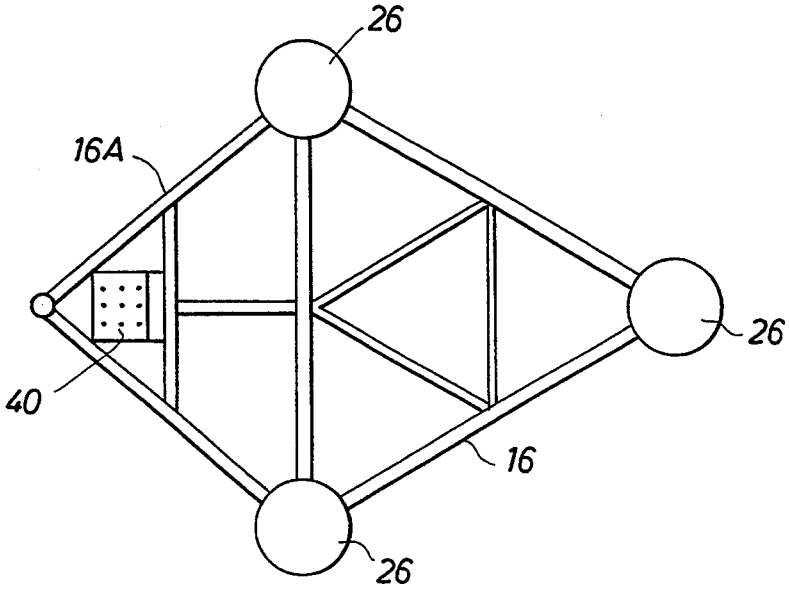
FIG. 7
FIG.8
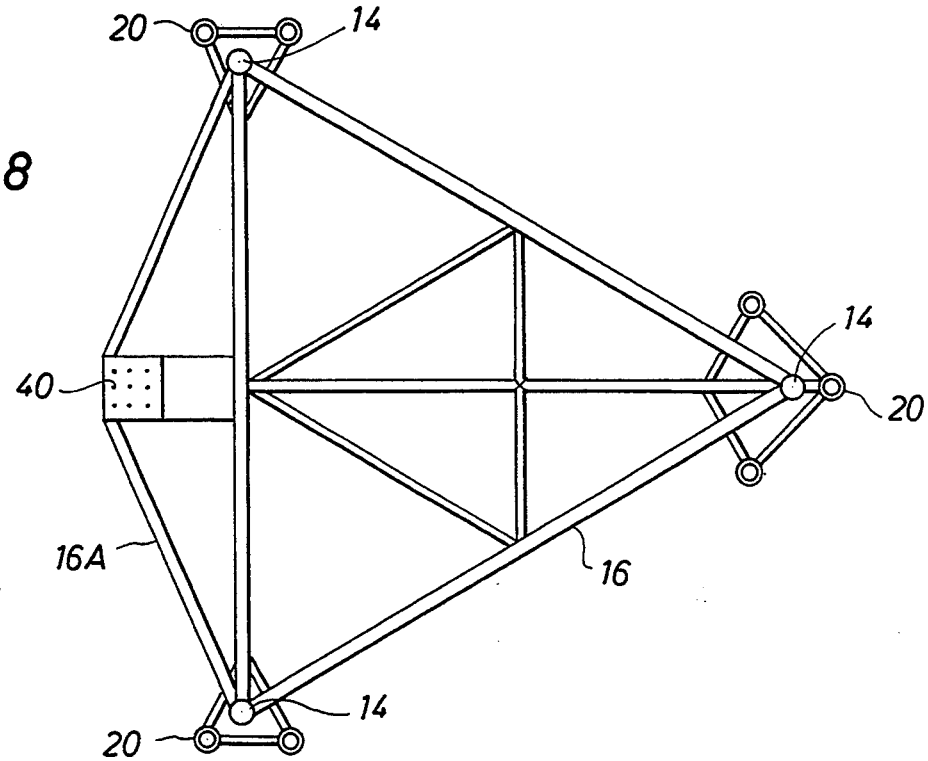

28
26
26
7
7
16A
16A
14
14
18
16
8
8
60
62
20
20
24
22
22

OFFSHORE PLATFORM STRUCTURE AND SYSTEM

BACKGROUND OF THE INVENTION

The present invention relates to a platform and system for conducting offshore hydrocarbon recovery operations. More particularly, the present invention relates to a platform structure and system for allowing the use of a jack-up rig in deeper water.

Jack-up rigs provide a derrick and associated equipment for drilling, completing or working over a well. This equipment is mounted to a combined hull/deck which is capable of floating these facilities to site. A plurality of retractable legs are provided which renders the jack-up rig conveniently portable. Once floated into position for conventional operations, the legs are jacked-down until they engage the seafloor. Further jacking transfers the load from the buoyant hull to the legs, then lifts the hull/deck out of the water and above the splash zone to produce a stable, bottom founded offshore platform for conducting well operations.

A consideration of this design is that to best take advantage of the mobile nature of the facilities provided on the jack-up rig, the rig is removed after drilling is complete and does not remain deployed at the development during the production phase except, possibly, for temporary workover or additional re-development operations. The considerable investment in drilling, completion and workover equipment is best utilized by redeploying the jack-up rig to another location as soon as these operations are complete. Thus, surface completions for production are not accommodated on the jack-up rig itself. A small structure called a "well jacket" can be used with the jack-up rig to provide the benefits of a surface completion with the convenience of a jack-up rig. However, well jackets and jack-up rig combinations are limited to shallow water deployment. Further, practical limitations on the length of the retractable legs more directly restrict the depth in which jack-up rigs can be traditionally deployed.

The requirements of deeper water depths have most often been answered by the continued use of traditional bottom founded platform structures. Topside facilities provide convenient well access for production operations. However, such structures must dedicate a significant amount of their structural strength to supporting drilling facilities that are only required for a relatively short period of time in the life of the overall operations from the platform in recovering oil and gas from a reservoir. Further, the structure must be able to withstand the maximum design environmental conditions, the design hurricane criteria, with these drilling facilities in place.

Of course, recovery operations lead to depletion of the hydrocarbon reservoir and, in time, the platform loses its usefulness at a site. Nevertheless, the well jacket that forms the tower supporting the deck of the platform may be structural sound and capable of an extended useful life. However, salvage operations are difficult and another constraint of traditional well jackets is that they are design specific for a given water depth. This tends to substantially limit re-deployment opportunities.

Certain designs have been proposed for "piggyback" deployment of a jack-up rig onto a subsea structure, yet these designs have carried forward many of the limitations of each structure producing a result that, although it increases water depth for the jack-up rig, otherwise remains the sum of the limitations of its constituent parts.

Thus, there continues to be a need for economically accommodating and even enhancing the benefits of surface completions and the convenience and economies of jack-up rig operations in deeper water.

SUMMARY OF THE INVENTION

Toward the fulfillment of this need, the present invention is an offshore platform structure for temporarily using a jack-up rig for well operations in deepwater applications. The structure has a bottom founded jacket base and a surface tower supported by the jacket base and extending above the ocean surface. A platform deck is supported by the surface tower and a subsea rig support interface is presented at the top of the jacket base and is adapted to receive the jack-up rig for well operations.

Another aspect of the present invention is an offshore platform system having a bottom founded jacket base with a plurality of legs and interconnecting framework. A subsea rig support interface is supported by the jacket base and a surface tower supported by the jacket base extends above the ocean surface to support a platform deck. Well operations equipment is provided on a jack-up rig having a plurality of legs which extend from a combination hull/deck member and engage the jacket base at the rig support interface. The well operations equipment provided centers around a withdrawable derrick, either on a sliding bridge in a slot-style jack-up rig or on a the cantilever deck in a cantilever deck style jack-up rig. Either withdrawable derrick system permits deployment of the jack-up rig upon the jacket base without interference with the surface tower, but then allows drilling operations after the derrick is brought into substantial vertical alignment with the surface tower.

Yet another aspect of the present invention is a method for providing a deepwater offshore platform in which an offshore platform structure is installed and a jack-up rig is mated thereon to establish a combined offshore platform system for conducting well operations during non-hurricane seasons. The jack-up rig is demobilized and withdraw from the offshore platform structure for hurricane season. This permits the combined offshore platform system to be designed on the less extreme basis of winter storm criteria and greatly reduces the loads of the offshore platform structure itself which is still designed to meet hurricane criteria.

BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in Which:

FIG. 1 is a side elevational view of an offshore platform structure in accordance with one embodiment of the present invention.

FIG. 2 is a cross sectional view of the offshore platform structure of FIG. 1 taken at line 2—2 in FIG. 1.

FIG. 3 is a cross sectional view of the offshore platform structure of FIG. 1 taken at line 3—3 in FIG. 1.

FIG. 5 is an alternate embodiment of a subsea rig support interface applicable to a practice of the present invention.

Figure 6:
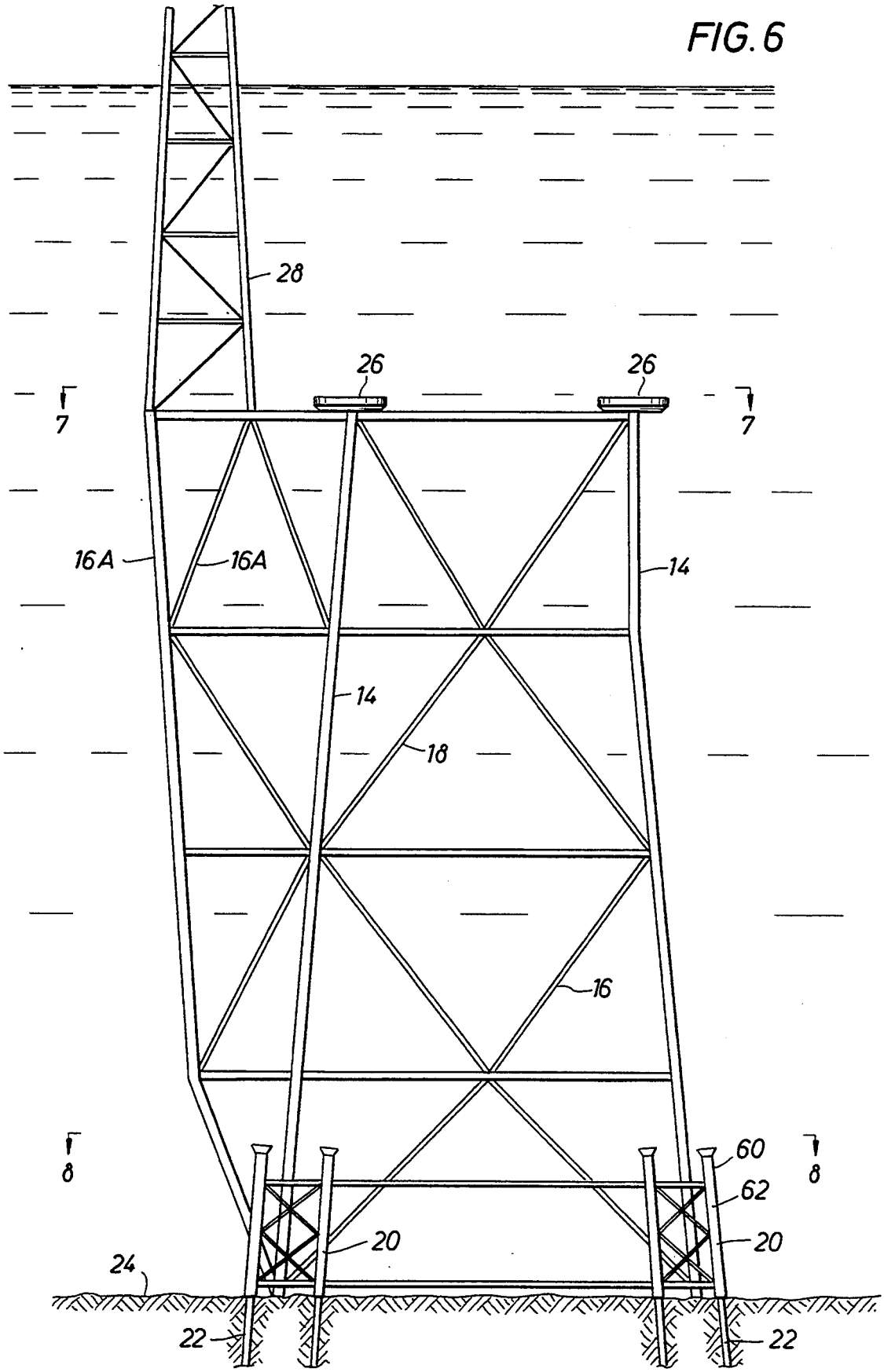
FIG. 6 is a side elevational view of an offshore platform structure in accordance with an alternate embodiment of the present invention.

FIG, 7 is a cross sectional view of the offshore platform structure of FIG. 6 taken at line 7—7 in FIG. 6.

FIG. 8 is a cross sectional view of the offshore platform structure of FIG. 6 taken at line 8—8 in FIG. 6.

Figure 9:
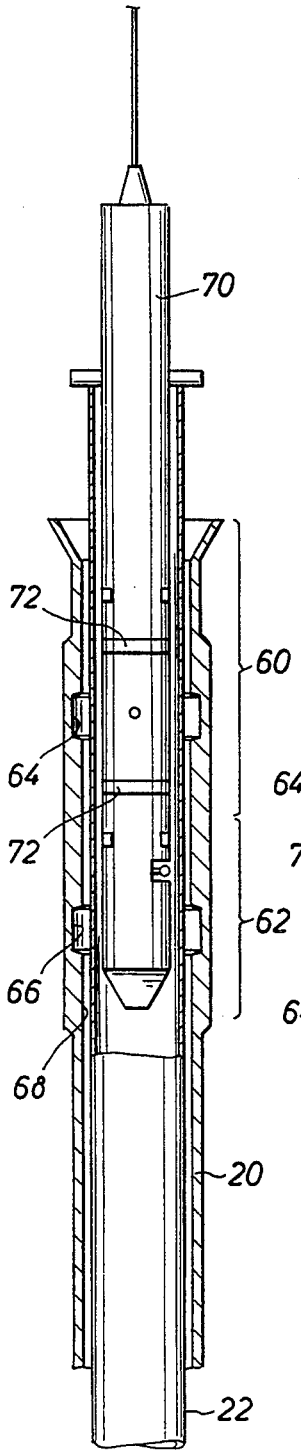

FIG. 9 is a cross sectional view of a pile deployed through a multi-stage pile sleeve taken from the vantage of line 9—9 in FIG. 1, but taken during installation.

Figure 10:
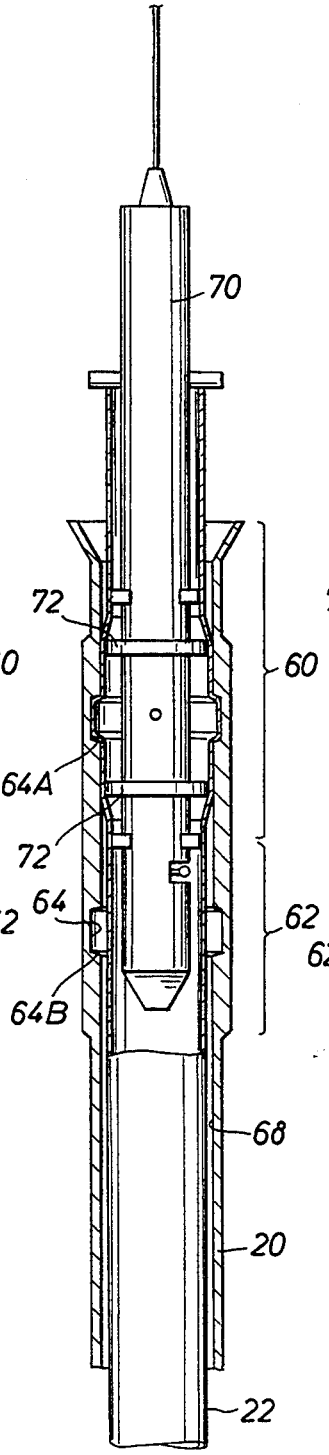

FIG. 10 is a cross sectional view of a locking tool securing the pile of FIG. 9 within the uppermost stage of the pile sleeve.

Figure 11:
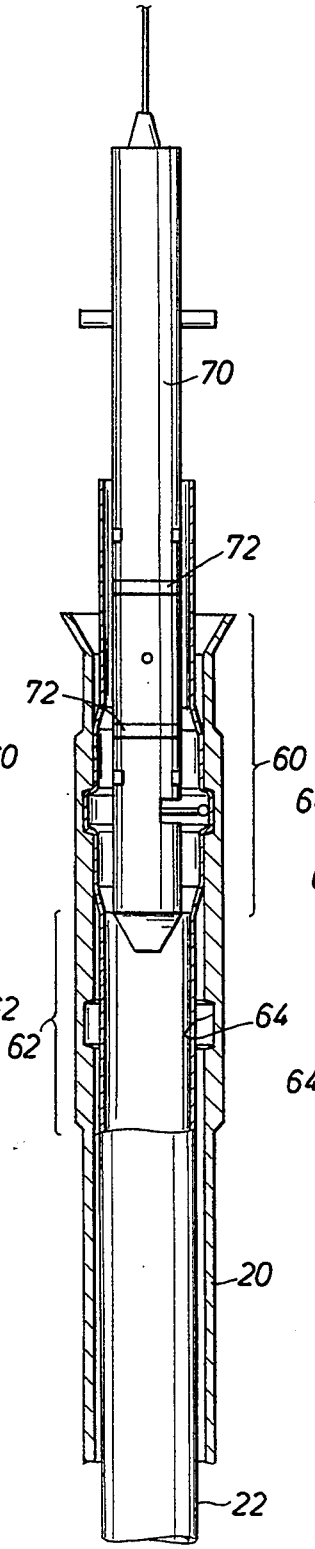

FIG. 11 is a cross sectional view of the withdrawal of the locking tool of FIG. 10 following swaging operations.

Figure 12:
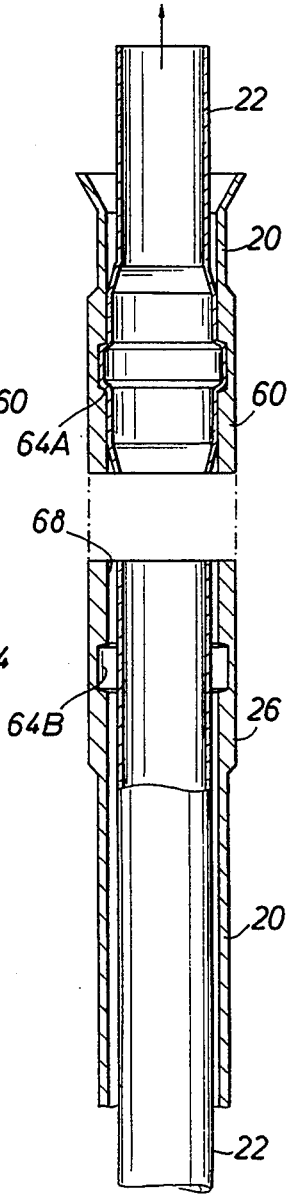

FIG. 12 is a cross sectional view of a first stage of the pile sleeve severed from latter stages to facilitate salvage and reuse of the jacket base.

DETAILED DESCRIPTION OF THE PREFERRED EMBODIMENTS

FIG. 1 illustrates offshore platform structure 10 in accordance with the present invention. Structure 10 has a bottom-founded jacket base 12 having legs 14 with an interconnecting framework 16 of braces 18. Piles 22 are installed into ocean floor 24 through pile sleeves 20 by drilling and grouting or driving procedures known in the art. The piles are then secured within the pile sleeves by hydraulic locking or grouting operations.

The top of jacket base 12 is provided with a plurality of subsea rig support interfaces 26 and further supports surface tower 28 which extends above ocean surface 30 to support platform deck 32. Rig support interfaces 26 and surface tower 28 are arranged to accommodate reception of a jack-up rig 34, here shown approaching offshore platform structure 10.

FIG. 2 is a cross section of offshore platform structure 10 illustrating a layout of subsea rig support interfaces 26 and surface tower 28 to accommodate a particular class of three leg jack-up rig (not shown). Thus, the rig support interfaces must be positioned to receive feet 36 of jack-up rig 34 and to efficiently transfer the load to legs 14 of offshore platform structure 10. The rig support interfaces should be below the wave zone, but well within the range of jack-up rigs, e.g., 200 feet or so below the ocean surface.

In one presently preferred embodiment, rig support interfaces 26 are provided by a load cushion 38A which is provided here by spud buckets 38 partially filled with a granular substance or other means to cushion the impact at touchdown and to disperse the load across the rig interface. The granular material must not only meet these load transfer characteristics, but also weather the environmental conditions and challenges such as scouring effects which tend to wash the granular material out of the open-top spud bucket even though it is positioned below the wave zone. Thus, sand, gravel or other granular material must be selected to accommodate these requirements. In one variation, cement or grout is placed in the spud bucket and sets after touchdown. Such a material may be selected to provide structural benefits to the system by resisting a moment applied across the jack-up rig to jacket base interface, yet to provide a limited adherence that is easily broken during de-mobilization of the jack-up rig for transfer to another site.

FIG. 5 illustrates another embodiment of subsea rig support interface 26 in which load cushion 38A is provided by a layer of cushioning material such as rubber or elastomeric cushion 38B over a steel lattice structure 38D. The lattice structure has a hole or receptacle 39 which receives a pin 37 on foot 36 for an advantage of more exact load placement and resistance to lateral loads. Further, if desired, hydraulically driven gripping arms 41 may be deployed to engage the edges of foot 36 to provide resistance to a moment applied across the jack-up rig to jacket base interface.

FIG. 2 also illustrates a plurality of conductors 40 arranged through surface tower 28. Drilling may be undertaken through each of the conductors using the jack-up rig which may also complete the well and set production risers through conductors 40. Alternatively, platform deck 32 may accommodate surface completions with a workover rig installed thereon. The platform deck of the surface tower also facilitates production while drilling ("PWD") operations by supplying deck space for production facilities not easily accommodated on jack-up rigs designed for drilling alone.

Figure 4:
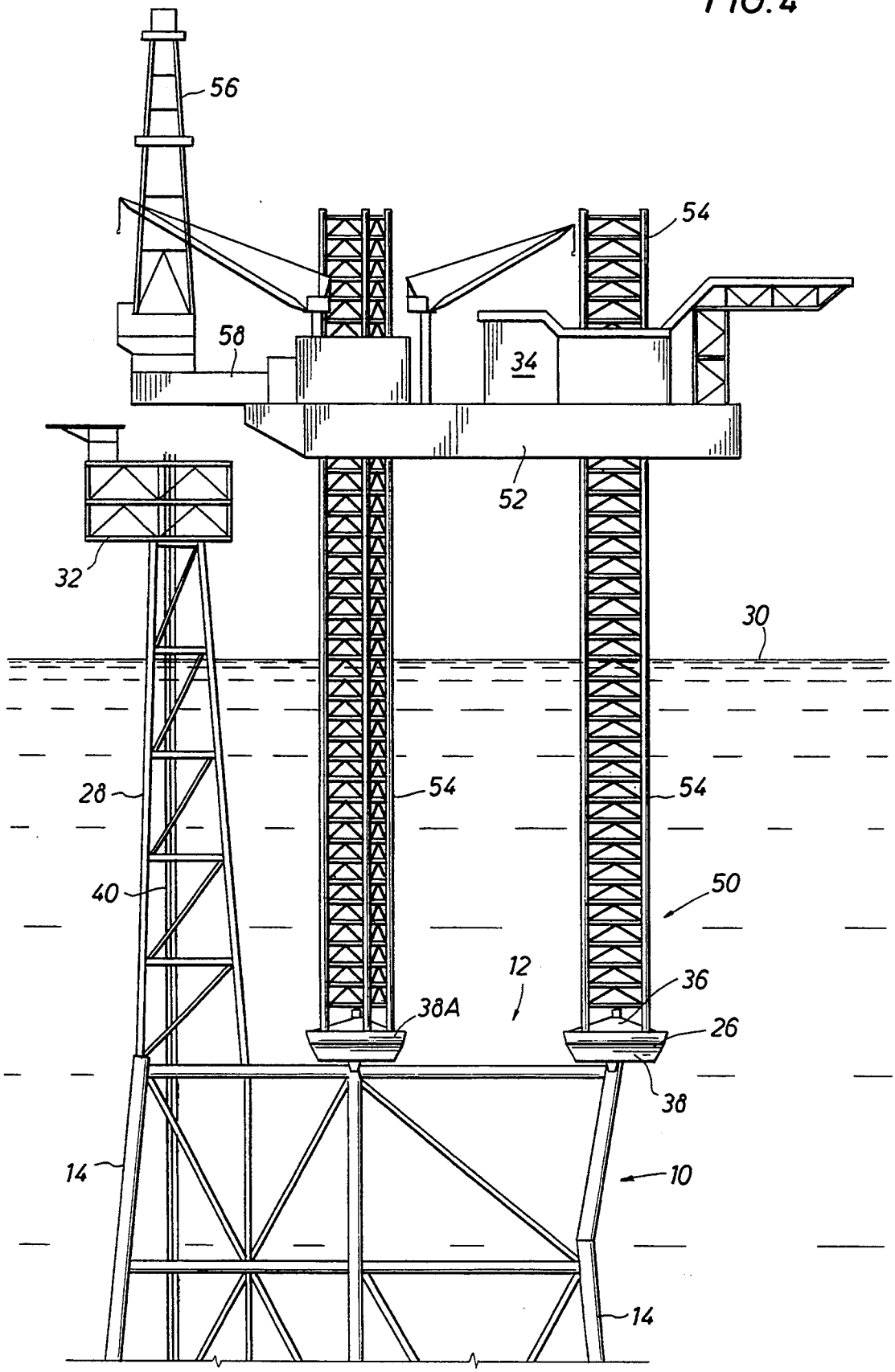
FIG. 4 is a side elevational view of an offshore platform system in accordance with one embodiment of the present invention, as viewed from the vantage of line 4—4 in FIG. 2, but including a deployed jack-up rig.

FIG. 4 illustrates jack-up rig 34 in place on jacket base 12 of offshore platform structure 10. Together these comprise offshore platform system 50. In this embodiment, jack-up rig 34 has three retractable legs 54 depending from a hull/deck member 52. Drilling and other facilities are provided by the jack-up rig, including a derrick 56, which is conveniently provided on a cantilever deck 58.

Deployment of jack-up rig 34 (see FIG. 1) is facilitated by means for aligning the jack-up rig with subsea rig support interfaces 26. This means may, for example, be provided in a cooperation between the hull/deck 52 of the jack-up rig as it floats in an alignment through a bumper engagement with a vertical face of surface tower 28 prior to jacking operations. Alternatively, at least one installation guide 42 may project substantially vertically above the periphery of one or more of spud buckets 38 to engage feet 36 on descending legs 54 during jacking operations. See FIGS. 1 and 2. Further, these and other means for alignment may be combined.

After touchdown of feet 36 within rig support interfaces 26, further jacking operation transfers the load of the jack-up rig from buoyant hull/deck 52 to jacket base 12, ultimately raising the hull/deck from the water, above the splash zone, and in position to extend retractable cantilevered deck 58 so as to position derrick 56 over surface tower 28. Well operations may then be shifted among the conductors by skidding the derrick on the cantilever deck without moving hull/deck 52 of the jack-up rig.

A comparison of the cross sections of FIGS. 2 and 3 illustrates another aspect of this embodiment. The cross section of FIG. 2 at the top of the jacket base is skewed to a diamond shape to provide support for the subsea rig support interfaces 26 in substantial alignment with legs 14 of the jacket base. However, this quadrilateral cross section does not extend outwardly the leg 14 which is associated with surface tower 28 at the first corner of the jacket base. Thus, the first corner is a shorter distance "a" from an intersection of lines diagonally bisecting the cross section at this level than distances "b" or "c" with respect to the other corners. This relationship contributes to providing a wide spread at subsea rig support interface 26 to accept the feet of jack-up rig 34, yet maintains surface tower 28 adjacent the jack-up rig for convenient access with a cantilevered deck.

By contrast, the cross section of FIG. 3 at the base of the offshore platform is a more conventional square or rectangular shape in this embodiment which facilitates traditional transport and deployment. FIG. 3 also illustrates the connection of pile sleeves 20 to legs 14.

FIGS. 6–8 illustrate another embodiment of the present invention in which jacket base 12 has three legs 14 arranged with braces 18 of framework 16 in a triangular cross section. Here surface tower 28 is supported by interconnecting framework 16A to the jacket base in a parallel, overlapping relation. This affords a minimal footprint to jacket base 12, thereby reducing material requirements. The structural requirements for surface tower 28 to support a facilities deck, workover rig, risers and riser conductors is much less than that required to support a jack-up rig 34. Separating these support requirements may allow an overall reduction in steel despite the overlap of surface tower 28 to jacket base 12.

Another aspect of the present invention addresses reducing costs not only by providing support only where it is needed but by designing a platform system 50 that matches structural capabilities to meet relevant design criteria on a seasonally adjusted basis. The ease of jack-up rig deployment and demobilization as a self-contained mobile unit facilitates employing a method of conducting platform operations that can further reduce platform costs.

Thus, offshore platform structure 10 is installed and jack-up rig 34 is mated thereon to establish an offshore platform system 50 for conducting well operations during non-hurricane seasons. However, the jack-up rig is demobilized and withdrawn from the offshore platform structure for hurricane season. This permits the combined offshore platform system 50 to be designed on the less extreme basis of winter storm criteria and greatly reduces the weight, wind and wave loads of the offshore platform structure 10 itself (absent the jack-up rig) which is still designed to meet hurricane criteria. This relation can even continue for embodiments of the offshore platform structure which include a workover rig on the platform deck.

Returning to the preferred embodiment for installing offshore platform structure 10, FIG. 9 is a longitudinal cross section of a pile 22 which has been secured to the ocean floor through pile sleeve 20. This cross section is taken from the vantage point of line 9—9 in FIG. 1, but illustrates an installation step in an embodiment of the present invention which facilitates reuse of offshore platform structure 10 after depletion of a reservoir.

In this embodiment, pile sleeve 20 is an open-ended cylindrical member having extended multiple stages, here illustrated by a first and second stage sleeves 60 and 62. First stage sleeve 60 projects coaxially from second stage sleeve 62 to facilitate access for salvage operations. See also FIG. 1. Both the first and second stage sleeves have locking profiles 64, here provided by an annular groove 66 on the interior surface of the cylindrical member 68.

Offshore platform structure 10 is launched, placed, and piles 22 are secured into the seafloor through pile sleeves 20 by driving or by drill and grout operations. At that point a locking tool 70 is run inside the pile which is held concentrically within the pile sleeve. See FIG. 9. Seals or packers 72 are activated to secure a hydraulic seal above and below the first locking profile 64A and to isolate the second locking profile 64B.

Hydraulic pressure is introduced to the interior of pile 22 through locking tool 70 to the annular region bounded by the locking tool and the pile between seals 72. The pressure extrudes or swages the pile into locking profile 64A to form a secure connection (see FIG. 10). Thereafter, seals 72 are deactivated and locking tool 70 is removed from the pile and is used for succeeding pile-to-pile sleeve connections as installation operations continue. Alternatively, mechanical swaging operations may be isolated to the first locking profile causing the pile to conform to the shape of the first locking profile in a secure engagement.

Offshore platform structure 10 may have a useful life exceeding the life of profitable production from the hydrocarbon reserves at the initial site of deployment. It may then be desired to salvage the offshore platform structure 10 for relocation. At this point surface facilities are removed to prepare the jacket base for recovery.

Placing the initial extruded locking engagement in an accessible location facilitates cutting operations, through both pile sleeves 20 and piles 22, around the base of the offshore platform structure. In the illustrated embodiment, first stage pile sleeve 62 is accessible as an extension projecting upwardly above the bracing which connects pile sleeves 20 to jacket leg 14 (see FIG. 1). However, other configurations may be employed.

Returning to embodiment of the practice illustrated in FIGS. 9–12, the first stage extension and the pile section therein is removed from the cylindrical members (see FIG. 12). This permits the jacket base to be floated or lifted by crane, readied for transport and carried to a new site. Second locking profile 64B remains available for a re-deployment of the offshore platform structure. Further, these salvage operations may be aided by providing additional ballast chambers within the platform jacket into which air may be pumped for a reserve buoyancy that facilitates one piece retrieval.

Another embodiment of multi-stage locking profile arrangements could accommodate a grouting operation. Grout is injected into segments of the pile/pile sleeve annulus to set and secure a connection. Packers isolate first and second stage portions of the pile/pile sleeve annulus for the final stage grouting operation. In one embodiment of this practice, the packer is recessed in an annular groove in the pile sleeve to allow free passage of the pile during pile installation, then inflated from the recess and deployed across the annulus by hydraulic power supplied through an external valve by a remotely operated vehicle ("ROV"). Grout is also supplied by an ROV and injected in to the annulus through an external valve.

In either embodiment, the multi-stage locking profile arrangement facilitates successive deployments of the offshore platform structure. Further, the jacket base has great flexibility for re-deployment throughout a range of water depths because drilling operations will be undertaken with a jack-up rig that may adjust to differences in water depths. Even if the surface tower is incompatible with the water depth at the re-deployment site, it is a relatively small structural component and may be replaced without sacrificing the more substantial savings attendant platform jacket reuse.

The present invention allows the use of a jack-up rig in deepwater, perhaps as deep as 1500 feet and maybe more, with fixed jacket and/or, providing dynamic considerations are adequately addressed, compliant tower design offshore platforms structures.

Another advantage of the present invention that impacts the over all economics of offshore operations is the ability to reduce cycle time, i.e., that period of time when substantial capital outlays are undertaken during platform construction and deployment before any revenue is seen from production. Relying upon a jack-up rig for drilling substantially reduces platform fabrication and rig-up time and cost.

Thus, various embodiments of the present invention can provide a multitude of benefits over conventional platforms, including a lower installed cost, shorter cycle time, support for staged development, and flexibility for reuse.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the present invention.

What is claimed is:

1. An offshore platform structure for temporarily using a jack-up rig for well operations in deep water applications comprising:

a bottom founded jacket base;

a surface tower supported by the jacket base having a plurality of corners and extending above the ocean surface;

a platform deck supported by the surface tower; and a subsea rig support interface presented at the top of the jacket base and adapted to receive the jack-up rig for well operations, said subsea rig support interface comprising:

a plurality of spud buckets, each supported substantially over one of the corners of the jacket base and positioned to receive the feet of a jack-up rig; and a layer of granular material in each spud bucket.

2. An offshore platform structure in accordance with claim 1 wherein the surface tower is supported at a first corner of the top of the jacket base.

3. An offshore platform structure in accordance with claim 2 wherein the jacket base has a quadrilateral horizontal cross section.

4. An offshore platform structure in accordance with claim 3 wherein a horizontal cross section at the bottom of the jacket base is substantially square and the cross section at the top of the platform base is characterized in that it is diamond shaped such that the first corner supporting the surface tower is a shorter distance from an intersection of lines diagonally bisecting the cross section than are the other corners, whereby a wide spread is accommodated at the rig support interface to accept the feet of the jack up rig which is then closely adjacent the surface tower.

5. An offshore platform structure in accordance with claim 3 wherein the jack-up rig to be accommodated is a three leg, cantilever deck design, receivable in an orientation such that a cantilever deck is alignable over the surface tower at the first corner of the top of the jacket base and the tops of the other corners support the subsea rig support interface.

6. An offshore platform structure in accordance with claim 1 wherein the jacket base has a triangular horizontal cross section.

7. An offshore platform in accordance with claim 6 wherein the surface tower is supported by the jacket base in a parallel, overlapping relation joined to a side of the jacket base by interconnecting framework.

8. An offshore platform structure in accordance with claim 1 wherein the granular material is sand.

9. An offshore platform in accordance with claim 1 further comprising a mating guide for aligning and maintaining the jack up rig in position for deployment onto the jacket base through the rig support interface.

10. An offshore platform in accordance with claim 9 wherein the mating guide comprises a guide surface on the surface tower.

11. An offshore structure in accordance with claim 1 further comprising a mating guide for aligning and maintaining the jack up rig in position for deployment onto the jacket base through the rig support interface, the mating guide comprising at least one installation guide extending substantially vertically above the periphery of one of the spud buckets.

12. An offshore platform system comprising:

a bottom founded jacket base having a plurality of legs and interconnecting framework;

a surface tower supported by the jacket base and extending above the ocean surface;

a platform deck supported by the surface tower;

a subsea rig support interface presented at the top of the jacket base; and a jack-up rig removably installed upon the jacket base, comprising;

a plurality of extendable legs, each engaging the rig support interface;

a combination hull and deck structure supporting well operations equipment; and a cantilever deck extending from the combination hull and deck structure presenting a derrick of the well operations equipment in substantial vertical alignment with the surface tower.

13. An offshore system in accordance with claim 12 further comprising:

a plurality of pile sleeves connected to the legs of the jacket base;

a plurality of piles secured to the ocean floor and engagingly received within the pile sleeves.

14. An offshore platform system in accordance with claim 12 wherein the subsea rig support interface further comprises a load cushion.

15. An offshore platform system in accordance with claim 14 wherein the feet of the jack-up rig present a pin and the subsea rig support interface comprises:

a lattice structure;

wherein the load cushion is a layer of cushioning material over the lattice structure; and a receptacle defined by the lattice structure to accept the pin.

16. An offshore platform system in accordance with claim 15 wherein the load cushion is a layer of rubber presented on the lattice structure.

17. An offshore platform system in accordance with claim 14 wherein the subsea rig support interface comprises:

a plurality of spud buckets supported by the jacket base and both substantially aligned with the legs of the jacket base and positioned to receive the feet of the jack-up rig; and wherein the load cushion is a layer of granular material in the spud buckets.

18. An offshore platform system in accordance with claim 17 wherein the layer of granular material is a layer of sand.

19. An offshore platform system in accordance with claim 12 wherein:

the jack up rig has three legs;

the surface tower is supported at one of the jacket legs at the top of a first corner of the jacket base; and the jacket base has a quadrilateral horizontal cross section which is substantially square at its base and is diamond shaped at the level of the subsea rig interface such that the first corner supporting the surface tower is a shorter distance from an intersection of lines diagonally bisecting the cross section than are the other corners, whereby a wide spread is accommodated at the rig support interface to accept the feet of the jack up rig which is then closely adjacent the surface tower.

20. An offshore platform system in accordance with claim 12 wherein:

the jacket base has a triangular horizontal cross section; and the surface tower is supported by the jacket base in parallel, overlapping relation joined to a side of the jacket base by interconnecting framework.

21. A method of providing a deepwater offshore platform comprising:

installing an offshore platform structure having a bottom founded jacket base, a surface tower supported by the jacket base and extending above the ocean surface, a platform deck supported by the surface tower suitable to support surface completed hydrocarbon wells, and a subsea rig support interface presented at the top of the jacket base;

mating a jack-up rig onto the offshore platform structure to establish an offshore platform system for conducting well operations during non-hurricane seasons; and demobilizing the jack-up rig and withdrawing the jack-up rig from the offshore platform structure for hurricane season;

whereby the offshore platform system need only be designed on the basis of winter storm criteria and the offshore platform structure which is designed to meet hurricane criteria and accommodate surface completed wells need not be sized to accommodate the jack-up rig in this extreme event.

22. An offshore platform structure for temporarily using a three-leg, cantilever design jack-up rig for well operations in deepwater applications comprising:

a bottom founded jacket base having a quadrilateral cross section with a first corner and three other corners;

a surface tower supported by the first corner of the top of the jacket base and extending above the ocean surface;

a platform deck supported by the surface tower; and a subsea rig support interface presented at the top of the jacket base and adapted to receive the jack-up rig for well operations, comprising a spud bucket supported substantially over each of the other corners of the jacket base positioned to receive the feet of a jack-up rig; and a layer of granular material in the spud bucket.

23. An offshore platform structure in accordance with claim 22 wherein the granular material is sand.

24. An offshore structure in accordance with claim 22 further comprising a mating guide for aligning and maintaining the jack-up rig in position for deployment onto the jacket base through the rig support interface, the mating guide comprising at least one installation guide extending substantially vertically above the periphery of one of the spud buckets.

25. An offshore platform structure for temporarily using a jack-up rig for well operations in deepwater applications comprising:

a bottom founded jacket base having a horizontal cross section at its bottom which is quadrilateral and substantially square and a cross section at the top of the platform base is characterized in that it is diamond shaped such that the first corner is a shorter distance from an intersection of lines diagonally bisecting the cross section than are the other corners;

a surface tower supported at a first corner of the top of the jacket base and extending above the ocean surface;

a platform deck supported by the surface tower; and a subsea rig support interface presented at the top of the jacket base and adapted to receive the jack-up rig for well operations;

whereby a wide spread is accommodated at the rig support interface to accept the feet of the jack-up rig which is then closely adjacent the surface tower.

26. An offshore platform structure for temporarily using a jack-up rig for well operations in deepwater applications comprising:

a bottom founded jacket base having a triangular horizontal cross section;

a surface tower supported by the jacket base and extending above the ocean surface;

a platform deck supported by the surface tower; and a subsea rig support interface presented at the top of the jacket base and adapted to receive the jack-up rig for well operations.

27. An offshore platform in accordance with claim 26 wherein the surface tower is supported by the jacket base in a parallel, overlapping relation joined to a side of the jacket base by interconnecting framework.

28. An offshore platform structure for temporarily using a jack-up rig for well operations in deep water applications comprising:

a bottom founded jacket base having a plurality of four corners and a quadrilateral horizontal cross section;

a surface tower supported by the jacket base and extending above the ocean surface;

a platform deck supported by the surface tower; and a subset rig support interface presented at the top of the jacket base and adapted to receive the jack-up rig for well operations, said jack-up rig to be accommodated being a three leg, cantilever deck design, receivable in an orientation such that a cantilever deck is alignable over the surface tower at a first of the corners of the top of the jacket base and the tops of the other three of the corners support the subsea rig support interface.

29. An offshore perform structure in accordance with claim 28 wherein the subsea rig support interface comprises:

a plurality of spud buckets, each supported substantially over one of the other three of the corners of the jacket base and positioned to receive the feet of a jack-up rig; and a layer of granular material in each spud bucket.

30. An offshore platform structure in accordance with claim 29 wherein the granular material is sand.

* * * * *